United States Patent [19]

Huempfner et al.

[11] 4,157,070

[45] Jun. 5, 1979

[54] AUXILIARY SHELVING ADAPTER

[75] Inventors: David F. Huempfner, Kewaunee; Floyd F. Mueller; Claude G. Kanzelberger, both of Two Rivers, all of Wis.

[73] Assignee: American Hospital Supply Corporation, Evanston, Ill.

[21] Appl. No.: 840,838

[22] Filed: Oct. 11, 1977

[51] Int. Cl.[2] ..... A47B 57/24

[52] U.S. Cl. ..... 108/28; 108/107; 248/235

[58] Field of Search ..... 108/59, 30, 107, 108, 108/109, 110, 32, 28; 211/135, 153, 186; 297/192; 248/223.1, 224.1, 226.5, 227, 235; 280/79.3

[56] References Cited

U.S. PATENT DOCUMENTS

| | | | |
|---|---|---|---|
| 955,883 | 4/1910 | Joiner | 108/30 |
| 1,427,249 | 8/1922 | Weston | 108/59 X |
| 1,962,504 | 6/1934 | Hauptli | 108/59 X |
| 2,680,522 | 6/1954 | Temple | 108/59 |
| 2,709,563 | 5/1955 | Starkey | 108/101 X |
| 2,721,663 | 10/1955 | James | 280/79.3 |
| 2,850,172 | 9/1958 | Beckner | 108/107 |
| 2,897,978 | 8/1959 | Beckner | 108/107 |
| 2,943,747 | 7/1960 | Shaw | 248/235 |
| 3,007,708 | 11/1961 | Ochs | 108/59 |
| 3,184,075 | 5/1965 | Cohen | 211/186 |
| 3,435,958 | 4/1968 | Chesley | 211/186 X |
| 3,584,915 | 6/1971 | Meyers, Jr. | 297/192 |
| 3,861,633 | 1/1975 | Rappleye | 248/227 |
| 3,920,260 | 11/1975 | Downing | 280/79.3 |

FOREIGN PATENT DOCUMENTS

| | | | |
|---|---|---|---|
| 1082203 | 9/1967 | United Kingdom | 211/186 |

*Primary Examiner*—James T. McCall

*Attorney, Agent, or Firm*—Tilton, Fallon,; Lungmus & Chestnut

[57] ABSTRACT

An auxiliary shelving adapter for use with a shelving assembly having at least one structural shelf supported by shelf supporting members such as corner posts or rails. Each adapter includes a pair of hangers adapted to be suspended from the structural shelf in spaced relationship inboard of an adjacent pair of corner posts at one end of the assembly. In addition, each adapter has a horizontally-elongated bracket joined to the hangers and adapted to support one end of an auxiliary shelf beneath the structural shelf. Abutment elements disposed at the lower end of each adapter engage the inboard surfaces of a pair of end posts to brace the adapter, maintain it in a plane generally parallel with such end posts, and securely but removably hold the end of the auxiliary shelf against horizontal endwise movement. The shelving assembly is equipped with a pair of such adapters at opposite ends thereof, the adapters cooperating with both the auxiliary shelf (or shelves) and the end posts to produce secure but nevertheless releasable support for such auxiliary shelf.

18 Claims, 6 Drawing Figures

AUXILIARY SHELVING ADAPTER

BACKGROUND

The present invention relates to a shelving adapter and, more particularly, to a removable auxiliary shelving adapter for use with a shelving assembly having at least one structural shelf supported by shelf supporting members such as corner posts or rails.

With many shelving assemblies now being used, structural shelves are supported by corner posts. It is common for one or more of the shelves to be permanently secured to such corner posts in order to provide a rigid assembly. The use of adjustable shelves in such assemblies is also common particularly in view of recent advancements making it possible to retain much of the rigidity normally associated with permanent shelves. It has been found that adjustable shelves and permanent shelves are sometimes inadequate, however, requiring the use of auxiliary shelves between the structural shelves. With this objective in mind, persons skilled in the art have sought to develop suitable auxiliary shelving adapters.

A shelving adapter for use with an assembly having non-structural shelves (i.e., shelves which are not an essential structural component for maintaining the integrity of such an assembly) has previously been disclosed in U.S. Pat. No. 3,007,708. To the extent that such an adapter is capable of outward swinging movement, however, it lacks the degree of rigidity which is important if not essential in many applications. While the prior art has dealt with the problem of providing supplemental shelving adapters with varying degrees of success, the present invention represents an improvement in removable auxiliary shelving adapters transcending such prior art constructions.

SUMMARY

The present invention is directed to a removable auxiliary shelving adapter for use with a shelving assembly having at least one generally rectangular structural shelf supported by shelf supporting members such as pairs of spaced end posts or rails. A pair of such adapters is utilized in spaced relation at opposite ends of the assembly. Each adapter includes a pair of hangers adapted to be suspended from the structural shelf inboard of a pair of end posts, a horizontally-elongated support bracket extending along the vertical plane of the hangers and secured adjacent its ends to such hangers, the bracket being adapted to receive and support an end of at least one auxiliary shelf, and abutment means adjacent the lower ends of the hangers for engaging inboard surfaces of the end posts and for bracing the adapter and the auxiliary shelf carried thereby against endwise movement. Since the support bracket of each adapter removably supports one or more auxiliary shelves at the end (or ends) thereof, such adapter may be used to add auxiliary shelving to a pre-existing assembly, or permit removal of said auxiliary shelving, in a quick, reliable, and effective manner.

In a preferred form of the invention, each hanger is of inverted J-shaped configuration, having an elongated vertical portion and a hook-shaped upper portion. The hook portion is adapted to cooperate with the structural shelf of a standard shelving assembly to suspend the adapter therefrom.

The support bracket of each adapter may take the form of a horizontally-elongated member of L-shaped cross-section, having an upstanding flange lying in a vertical plane spaced from and generally parallel to the plane defined by the hangers. Such bracket may be formed of sheet material or of wire and, in either event, provides secure support for one end of an auxiliary shelf. In most cases the auxiliary shelf will be supported in horizontal condition; however, the bracket may be provided with an extension, either integral therewith or added thereto, for supporting such a shelf in inclined condition.

The abutment means of each adapter takes the form of a pair of arms which project outwardly in opposite directions adjacent the lower ends of the vertical hangers and which then curve to provide arcuate portions which embrace circumferential portions of the corner posts. Such arms are preferably resilient or flexible or provide a spring latching interconnection with such posts while at the same time permitting detachment therefrom when removal of the adapter is desired. Particularly effective results are obtained when such arms constitute extensions of a horizontal wire connecting member which joins the lower end portions of the hangers of each adapter.

The present invention retains the advantages inherent in shelf adapters while at the same time providing an improved construction having many features not heretofore available. It is therefore an object of the present invention to provide a removable auxiliary shelf adapter for use with a shelving assembly having at least one structural shelf supported by corner posts which permits adding one or more auxiliary shelves to a pre-existing shelving assembly in a quick, reliable, and effective manner. Another object of this invention lies in providing a pair of such adapters which, in combination with a shelving assembly having at least one structural shelf supported by corner posts, cooperates with such corner posts or rails to provide rigid but removable support for one or more auxiliary shelves. The provision of such a shelving adapter and the realization of the advantages to be derived therefrom constitute additional important objects of the present invention with still other objects being appreciated from the details of construction set forth in the accompanying specification, claims and drawings.

DRAWINGS

DESCRIPTION

Figure 1:
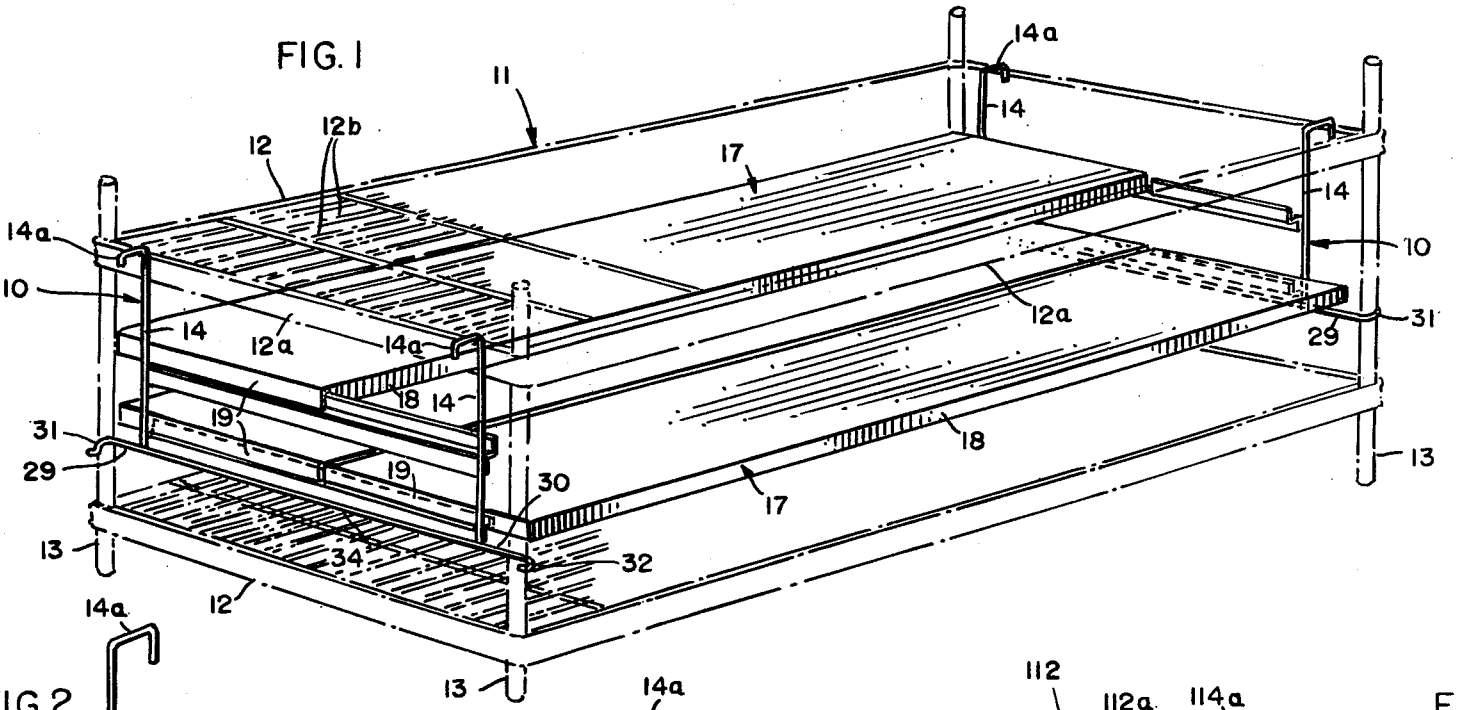
FIG. 1 is a partial perspective view of a shelving assembly having a structural shelf supported by corner posts utilizing a pair of removable auxiliary shelving adapters in accordance with the present invention.

In the illustration given and with reference first to FIG. 1, a pair of auxiliary shelving adapters 10 are illustrated in position for use on a shelving assembly 11. The assembly 11 has at least one structural shelf of rectangular configuration supported at its corners by shelf supporting means such as end posts 13. The term "structural shelf" is used herein to mean a shelf which is an integrated part of the basic assembly and on which the assembly depends at least in part for its structural integrity. Two such shelves 12 are shown in FIG. 1, each taking the form of a wire shelf having a rectangular frame 12*a* and a supporting surface of intersecting wire elements 12*b*. It is to be understood, however, that other types of shelves may form the structural shelves of the assembly and that, in particular, such structural shelves need not be composed of intersecting wire elements.

Figure 2:
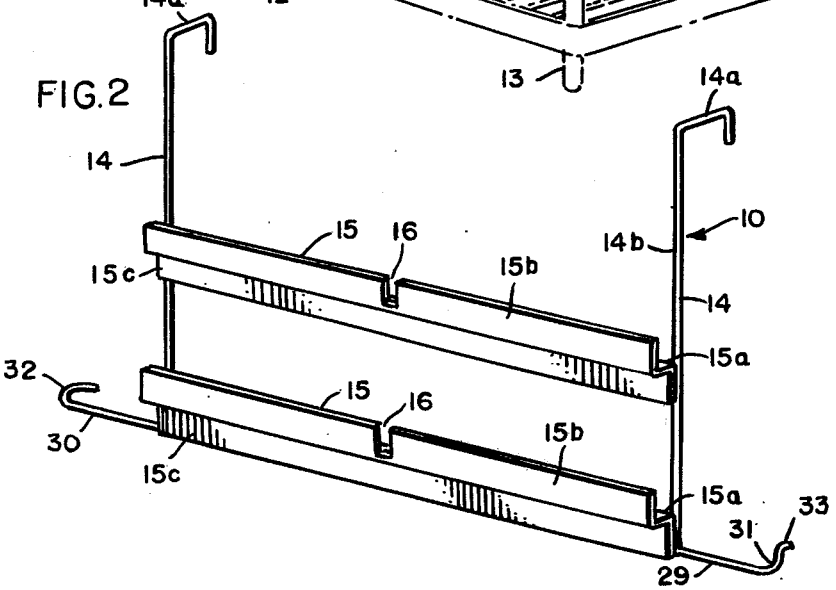
FIG. 2 is a perspective view of one of the removable auxiliary shelving adapters of FIG. 1.

Referring to FIGS. 1 and 2, each of the adapters 10 includes a pair of hangers 14 which extend vertically in a plane parallel with, and just inboard in relation to, a pair of adjacent end posts 13. Each hanger includes a hook portion 14*a* at its upper end, the two hook portions of an adapter 10 being adapted to engage one of the horizontal end members of the frame 12*a* of the structural shelf 12 to suspend the adapter as depicted in FIG. 1. Both the hook portion 14*a* and the main vertical leg portion 14*b* of each hanger may be formed from a single metal rod bent in the form of an inverted J as shown most clearly in FIG. 2.

Each adapter 10 includes, in addition to the pair of spaced parallel hangers 14, at least one horizontally-elongated support bracket 15. The ends of each bracket are welded or otherwise rigidly secured to the spaced hangers. In FIG. 2, two such brackets 15 are illustrated; however, it is to be understood that a greater or smaller number may be provided as desired. It will be observed that each bracket includes a horizontal wall portion 15*a* and an upstanding flange portion 15*b*, the flange 15*b* being spaced inwardly from the vertical plane of hangers 14 and preferably being provided intermediate its length with an upwardly-opening notch 16. Although the bracket may be rigidly secured to the hangers in any suitable manner, it has been found particularly effective to provide each bracket with a depending vertical wall 15*c* which not only provides a greater surface for the welded connection between the parts but also enhances the structural rigidity of each bracket and the adapter as a whole.

The auxiliary shelving may take the form illustrated in FIG. 1, wherein each auxiliary shelf 17 is formed of sheet material and has downwardly turned side and end flanges 18 and 19, respectively. If desired, auxiliary shelf 17 may extend the full width of the assembly; however, it is believed particularly desirable to form each shelf in two separate sections as shown, each section being half the width of a full shelf. The depending end flanges 19 of each auxiliary shelf are spaced apart a distance slightly greater than the upstanding flanges 15*b* of a pair of adapters 10 suspended at opposite ends of the shelf assembly 11, with the result that each flange 19 of an auxiliary shelf is disposed between an upstanding flange 15*b* and the vertical plane defined by hanger portions 14*b*. In addition, side flanges 18 of each half-shelf along the longitudinal mid line of the shelf assembly are received in notches 16 of brackets 15, thereby locking each auxiliary shelf (or auxiliary shelf section) against both longitudinal and lateral horizontal movement.

Figure 5:
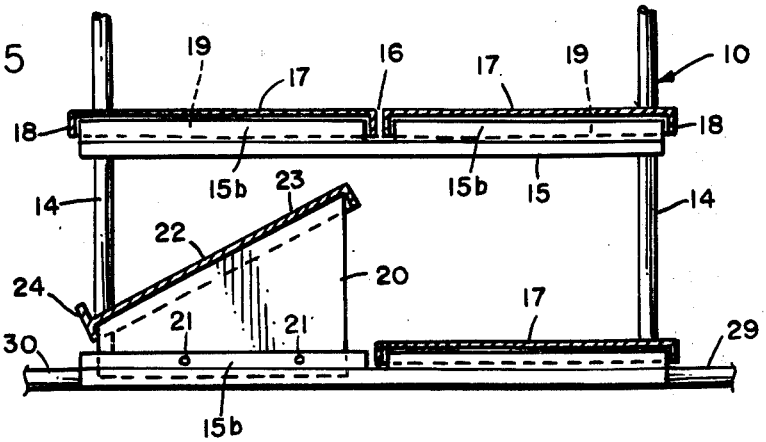
FIG. 5 is an end view of a shelving assembly having a structural shelf supported by corner posts utilizing a removable auxiliary shelving adapted with an inclined full-bracket adapter.

The relationship between an auxiliary shelf 17 and a bracket 15 is further depicted in FIG. 5. Upstanding flanges 15*b* of the upper bracket 15 are received within the downwardly-facing recesses defined by depending flanges 18 and 19 of shelves (or shelf sections) 17, the adjacent flanges 18 of the shelves being received in notch 16. The lower bracket of the same adapter similarly supports a horizontal auxiliary shelf section 17 as shown on the right side of that bracket; however, the left side of the bracket is equipped with an upstanding extension 20 connected by bolts 21 or by any other suitable means to flange 15*b*. The upper edge 22 of extension 20 is inclined downwardly and laterally to support a modified shelf 23 in the sloping position shown. Shelf 23 which can either be of solid or wire mesh construction is substantially identical to any of the other auxiliary shelves 17 except for the provision of an upstanding lip 24 along its lower longitudinal side edge. It is believed apparent that the lip 24 serves as a stop to prevent articles, such as boxed medical dressings, from sliding off of the top surface of auxiliary shelf 23.

Figure 6:
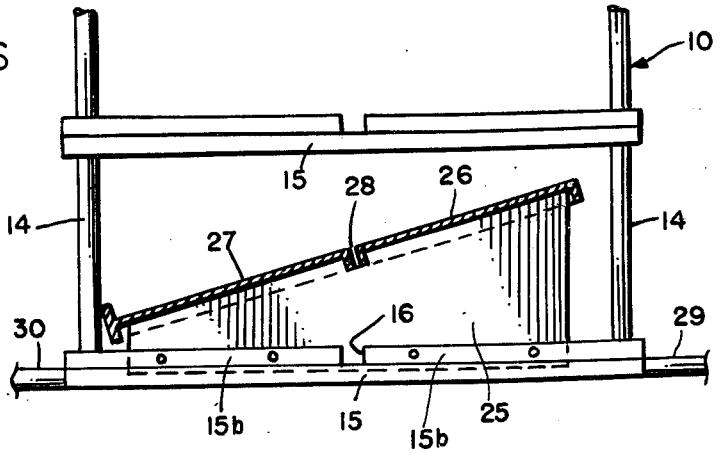
FIG. 6 is an end view of a shelving assembly having a structural shelf supported by corner posts utilizing a removable auxiliary shelving adapter with an inclined half-bracket adapter.

FIG. 6 illustrates a further modification wherein no auxiliary shelves are supported by the upper bracket 15 and the lower bracket is equipped with an enlarged vertical extension 25 bolted or otherwise rigidly secured to the upstanding flanges 15*b* of the lower bracket. A pair of auxiliary shelves 26 and 27 are supported upon extension 25 in the same manner as the auxiliary shelves have been previously described as being supported directly on bracket 15 or on bracket extension 20. Auxiliary shelf 26 which can either be of solid or wire mesh construction is substantially identical to previously-described shelf 17, and auxiliary shelf 27 is essentially the same as shelf 23. The bracket extension 25 is shown as being recessed to provide a notch 28 which performs the same function as notch 16 of a bracket used without such an extension. It is believed apparent that the auxiliary shelf of FIG. 6 might be formed as a unitary structure rather than as a pair of sections 26 and 27, and that the upstanding bracket extensions 20 and 25 might be formed integrally with the brackets rather than be secured thereto as added elements.

Referring again to FIGS. 5 and 6, it will be appreciated that the inclined auxiliary shelves 23 and 26 provide important advantages particularly for uses such as a dispensing means for boxed medical dressings. Older stock, intended to be used first, slides forward, and is retained by the lip 24. New stock, preferred for use later, is loaded behind the older stock. While the inclined extensions 20 and 25 have been shown as fixed supports for the shelves 23 and 26, it will be appreciated that the shelves 23 and 26 can be moved between a horizontal orientation and varying degrees of slant simply by making the extensions 20 and 25 adjustable.

Each adapter 10 is provided with means for securely bracing it against horizontal movement, particularly endwise swinging movement, relative to the shelving assembly 11. Such means takes the form of a pair of arms 29 and 30 which extend laterally in opposite directions from the lower end of the adapter and in generally the same plane as the vertical portions of hangers 14 (FIG. 2). The arms serve as abutment elements for firmly engaging the inboard or inwardly-facing surfaces of end posts 13. It is believed apparent, therefore, that when the parts are assembled as illustrated in FIG. 1, outward swinging movement of each adapter is positively prevented by engagement between arms 29–30 and posts 13, and inward swinging movement is blocked, at least in part, by auxiliary shelves 17 (or 23, 26, 27).

It will also be noted that the ends of arms 29 and 30 are provided with arcuate portions 31 and 32, respectively. Specifically, the arms curve horizontally in the same direction away from the plane of hanger portion 15*b* as hook portions 14*a*. The curvatures of arcuate portions 31 and 32, the spacing of those portions from each other, cause the arcuate portions to embrace circumferential portions of end posts 13, thereby further preventing inward swinging movement of the adapters 10 (even in the absence of auxiliary shelving 17) and firmly locking the adapters against transverse sliding movement (i.e., horizontal displacement in the vertical plane of hangers 14) when the parts are assembled as shown.

Arms 29 and 30 are formed of a flexible material such as spring metal. At least one of the arcuate portions (such as portion 31) has a reverse curvature 33 at its extreme end to facilitate attachment of an adapter to end posts 13. After arcuate portion 32 is hooked about one of the end posts, the reversely curved portion 33 is urged into forceful contact with the other end post to cam the arcuate portions of the spring arms apart a distance to permit portion 31 to snap into place. The resilience of the spring arms thereafter retains the arcuate portions in firm contact with the end posts.

In the form depicted in FIGS. 1 and 2 (also 5 and 6), arms 29 and 30 are joined by a connecting portion 34, the arms and connecting portion all being integral portions of the same horizontal spring rod which spans a pair of end posts 13 (FIG. 1).

The cooperative relationship between the adapters 10, the auxiliary shelves 17 (or 23, 26, 27), and the shelving assembly 11 is believed evident from the foregoing. The assembly 11 with its corner posts 13 and one or more structural shelves 12 is itself of standard or well-known construction. Although each permanent shelf 12 is shown as having a wire grid 12*b*, the only essential requirement is that each such shelf have horizontal end frame members accessible to the hook portions 14*a* of hangers 14. The shelving assembly may, of course, take various other forms such as a shelf cart unit or a wall shelf unit with either wire mesh shelves or solid shelves and with the hangers 14 being suitably adapted to be suspended in the manner described regardless of the form of the structural shelf 12.

Figure 3:
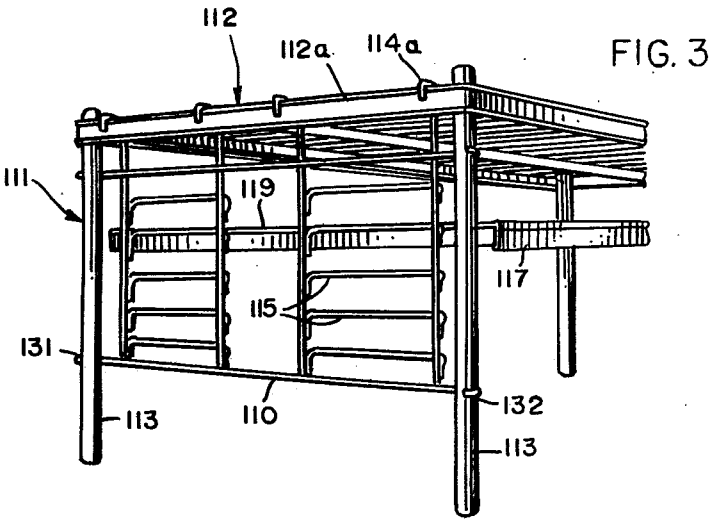
FIG. 3 is a partial perspective view of a shelving assembly having a structural shelf utilizing a pair of removable auxiliary shelving adapters in accordance with a second embodiment of the present invention.
Figure 4:
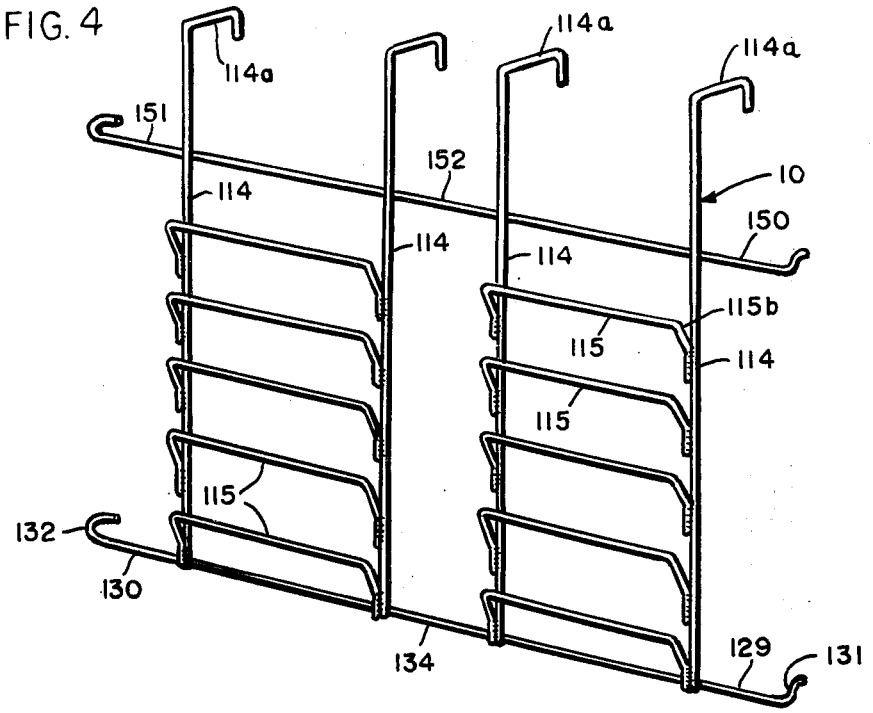
FIG. 4 is a perspective view of one of the removable auxiliary shelving adapters of FIG. 3.

FIGS. 3 and 4 illustrate another embodiment of the invention. Although adapter 110 differs structurally in some respects from adapter 10, the two function in essentially the same way. Adapter 110 includes a plurality of vertically-extending hangers 114 with hook portions 114*a* at their upper ends. Spring arms 129 and 130, joined by integral connecting portion 134, are secured to the hangers at the lower ends thereof. The spring arms are provided with arcuate portions 131 and 132 which cooperate with end posts 113 in the manner described in connection with the embodiment of FIGS. 1 and 2. Hook portions 114*a* are hooked upon the end frame member 112*a* of structural shelf 112. If desired, additional bracing may be provided with a secondary pair of spring arms 150 and 151, joined by integral connecting portion 152 and disposed directly above and parallel with the lower arms 129–130 and connecting portion 134.

Unlike the adapter of the first embodiment, however, adapter 110 is provided with one or more brackets 115 which are formed of wire rather than sheet metal. Multiple brackets are illustrated in FIGS. 3 and 4 to permit the positioning of auxiliary shelf 117 at any of a variety of selected elevations. In FIG. 3 the auxiliary shelf 117 is shown to be a unitary structure rather than a divided shelf as previously described in connection with the embodiments of FIGS. 1 and 2; however, the functional relationship is the same in each case. The wire brackets 115 are of inverted U-shaped configuration and slope outwardly to define portions 115*b* which function essentially the same as flanges 15*b* of the first described embodiment. While auxiliary shelf 117 may be provided with end flanges which are hooked over the wire brackets 115 at a selected elevation, FIG. 3 reveals that a similar result may be achieved by simply providing the auxiliary shelf with an end rod 119 which is hooked upon the brackets in the same fashion.

With all of the disclosed embodiments, it is possible to use the shelving adapters in a manner allowing auxiliary shelves to be added between adjacent structural shelf assemblies. This can be done in numerous ways including end-to-end, side-to-side, or end-to-side. An advantage of using the shelving adapters in this fashion is to add additional shelving without the expense of additional structural shelf assemblies. This is particularly desirable for relatively permanent, stationary shelving. An additional advantageous use of the shelving adapters can be made by constructing the parallel hangers as parallel supports adapted to be supported on rather than suspended from the structural shelf. This construction would still utilize the abutment means for bracing the parallel supports against outward movement. While minor changes in construction and installation would be required, it is believed in view of the present invention that such changes would be readily apparent to one skilled in the art.

While the foregoing embodiments of the invention have been disclosed in considerable detail for purposes of illustration, it will be understood that variations of the details herein given may be made by those skilled in the art without departing from the spirit and scope of the invention.

We claim:

1. In combination with a shelf assembly having at least one generally rectangular structural shelf supported at opposite ends thereof by pairs of spaced end posts, at least one auxiliary shelf, and means for securely but removably suspending said auxiliary shelf beneath said structural shelf, said means comprising a pair of adapters adjacent opposite ends of said assembly, each adapter having a pair of spaced hangers extending along a plane parallel with a pair of said end posts and having hooks at the upper ends thereof engaging said structural shelf, bracket means extending between and secured to the hangers of each adapter for supporting one end of said auxiliary shelf, and abutment means adjacent the lower end of each adapter for engaging inboard surfaces of a pair of said end posts to brace and secure the lower end of such adapter against horizontal movement relative to said assembly.

2. The combination of claim 1 in which said abutment means comprises a pair of arms extending along said plane in opposite directions adjacent the lower ends of said hangers.

3. The combination of claim 2 in which said arms comprise opposite end portions of a horizontal connecting member secured to said hangers adjacent the lower ends thereof.

4. The combination of claim 3 in which each of said arms has an arcuate portion embracing a portion of the circumference of one of said end posts.

5. The combination of claim 4 in which said arms are formed of flexible material and yieldably engage and releasably receive said circumferential portions of said end posts.

6. The combination of claim 5 in which said arms are formed of spring metal.

7. The combination of claim 1 in which said bracket means provides an upstanding horizontal flange having an upper edge spaced inwardly from the vertical plane of said hangers, said auxiliary shelf having a depending wall portion hooked over said upstanding flange for supporting said auxiliary shelf upon said bracket means.

8. The combination of claim 1 in which said bracket means includes an upstanding horizontal flange spaced inwardly from said pair of end posts, said flange having an upwardly-opening notch intermediate opposite ends thereof, and said auxiliary shelf having a depending flange received in said notch.

9. The combination of claim 1 in which said bracket means of each adapter includes an upwardly extending member having an inclined upper edge, said auxiliary shelf being supported upon said inclined upper edges of the upwardly extending members of the bracket means of said adapters.

10. An auxiliary shelving adapter for use with a shelf assembly having at least one structural shelf supported by spaced pairs of end posts and having an auxiliary shelf to be supported below said structural shelf, said adapter extending along a generally vertical plane and comprising a pair of spaced upstanding hangers provided at their upper ends with hooks for engaging the structural shelf of a shelf assembly for suspending said adapter therefrom, said hooks projecting from one side of said adapter and away from said vertical plane in generally parallel relation with each other, said hangers also being provided adjacent their lower ends with a pair of arms projecting laterally in opposite directions for engaging the end posts of a shelf assembly to brace said adapter against outward swinging movement in the direction of said hooks, and an elongated horizontal support bracket having opposite end portions secured to said hangers substantially below said hooks and having an upstanding longitudinal flange for engaging and supporting an auxiliary shelf.

11. The adapter of claim 10 in which said flange is disposed along the side of said adapter opposite from said one side and is spaced inwardly from said hangers.

12. The adapter of claim 10 in which said arms comprise opposite end portions of a horizontal connecting member secured to said hangers adjacent the lower ends thereof.

13. The adapter of claim 10 in which each of said arms has an arcuate portion adapted to embrace a portion of the circumference of a corner post.

14. The adapter of claim 13 in which said arms are formed of flexible material and are adapted to yieldably engage and releasably receive a circumferential portion of a corner post.

15. The adapter of claim 11 in which said horizontally elongated bracket is formed of wire.

16. The adapter of claim 11 in which said horizontally elongated bracket is formed of sheet material, said bracket including a generally horizontal portion merging with said flange at the lower end thereof and being joined to said hangers.

17. The adapter of claim 16 in which said upstanding flange is provided with an upwardly-opening notch intermediate its ends for receiving the depending flange of at least one auxiliary shelf.

18. The adapter of claim 11 in which said bracket includes extensions means having a slanted upper edge for supporting an auxiliary shelf in inclined position.

* * * * *